US007372001B2

(12) United States Patent
Tachikawa et al.

(10) Patent No.: US 7,372,001 B2
(45) Date of Patent: May 13, 2008

(54) CERAMICS HEATER

(75) Inventors: Toshihiro Tachikawa, Yokohama (JP); Junichi Miyahara, Yokohama (JP); Toshihiko Hanamachi, Yokohama (JP)

(73) Assignee: NHK Spring Co., Ltd., Tokohama-shi (JP)

( * ) Notice: Subject to any disclaimer, the term of this patent is extended or adjusted under 35 U.S.C. 154(b) by 0 days.

(21) Appl. No.: 10/321,707

(22) Filed: Dec. 17, 2002

(65) Prior Publication Data

US 2004/0112888 A1 Jun. 17, 2004

(51) Int. Cl.
*H05B 3/68* (2006.01)

(52) U.S. Cl. ..... 219/468.1; 219/444.1

(58) Field of Classification Search ..... 219/444.1, 219/466.1, 468.1, 543, 544, 546, 547, 548; 338/283, 287, 307, 308
See application file for complete search history.

(56) References Cited

U.S. PATENT DOCUMENTS

| | | | | | |
|---|---|---|---|---|---|
| 4,804,823 | A * | 2/1989 | Okuda et al. | ..... | 219/553 |
| 4,843,218 | A * | 6/1989 | Husslein et al. | ..... | 219/466.1 |
| 5,151,871 | A * | 9/1992 | Matsumura et al. | ..... | 700/300 |
| 5,314,541 | A | 5/1994 | Saito et al. | ..... | 118/725 |
| 5,397,396 | A | 3/1995 | Kosky et al. | ..... | 118/924 |
| 5,591,269 | A | 1/1997 | Arami et al. | ..... | 118/723 |
| 5,665,166 | A | 9/1997 | Deguchi et al. | ..... | 118/723 |
| 5,683,606 | A * | 11/1997 | Ushikoshi et al. | ..... | 219/544 |
| 6,080,970 | A * | 6/2000 | Yoshida et al. | ..... | 219/444.1 |
| 6,242,719 | B1 * | 6/2001 | Kano et al. | ..... | 219/444.1 |
| 6,448,538 | B1 * | 9/2002 | Miyata | ..... | 219/444.1 |
| 6,891,263 | B2 * | 5/2005 | Hiramatsu et al. | ..... | 257/703 |
| 2001/0029895 | A1 | 10/2001 | Hanamachi et al. | ..... | 118/725 |
| 2001/0055190 | A1 | 12/2001 | Saito et al. | ..... | 361/234 |

FOREIGN PATENT DOCUMENTS

| | | |
|---|---|---|
| JP | 5343167 | 12/1993 |
| JP | 3011528 | 12/1999 |
| JP | 2000231980 | 8/2000 |
| JP | WO0076273 | 12/2000 |
| KR | 5-343167 | 12/1993 |
| KR | 12-231980 | 8/2000 |

OTHER PUBLICATIONS

Office Action dated Oct. 29, 2004 from corresponding Korean Application.

* cited by examiner

*Primary Examiner*—Sang Paik
(74) *Attorney, Agent, or Firm*—Ohlandt, Greeley, Ruggiero & Perle, L.L.P.

(57) ABSTRACT

A ceramics heater comprises a circular heater plate formed of aluminum nitride and a metal foil heater wire formed of a high-melting metal and having a thickness of 100 μm to 175 μm. The heater wire is embedded in the heater plate. The heater wire has an inside portion located near the center of the heater plate and formed in zigzags at first pitches in the circumferential direction of the heater plate and an outside portion located near the outer periphery of the heater plate and formed in zigzags at second pitches in the circumferential direction of the heater plate. The second pitches are shorter than the first pitches.

6 Claims, 4 Drawing Sheets

CERAMICS HEATER

CROSS-REFERENCE TO RELATED APPLICATIONS

The entire contents Japanese Patent Application No. 2001-188285, filed Jun. 21, 2001, are incorporated herein by reference.

BACKGROUND OF THE INVENTION

1. Field of the Invention

The present invention relates to a ceramics heater used to heat works such as wafers, glass substrates, etc. in semiconductor manufacturing processes or the like, for example.

2. Description of the Related Art

Ceramics heaters for heating wafers are used to perform CVD (chemical vapor deposition), PVD (plasma vapor deposition), etching, etc. in semiconductor manufacturing processes. The ceramics heaters are also used in filming apparatuses for forming thin films on glass substrates.

A conventional ceramics heater, such as the one described in Jpn. Pat. Appln. No. 3011528, includes a heater plate of ceramics, a metal foil heater wire embedded in the heater plate, etc. The heater plate is formed of a sintered product of silicon nitride or aluminum nitride. The metal foil heater wire, which is formed of a high-melting metal such as tungsten, is embedded concentrically or spirally in the heater plate.

In one such conventional ceramics heater, a metal foil heater wire having a thickness of 50 μm or less, in particular, is embedded in sintered ceramics. Possibly, the ceramics heaters involve the following problems.

[Problem 1]

Since the heater wire is thin and has a small cross section, its area ratio (S1/S2) is very low. S1 is the overall surface area of the heater wire, and S2 is the area of a work bearing surface of the heater plate. In this case, the heater plate has a lot of regions that are apart from the heater wire in the diametrical direction. Therefore, the temperature change in the diametrical direction increases with distance from the center of the heater plate, as indicated by two-dot chain line L1 in FIG. 4. Thus, the conventional ceramics heater is poor in temperature uniformity.

The heater plate for heating wafers in the semiconductor manufacturing processes, in particular, requires the maintenance of uniform temperature distribution, so that unevenness in its temperature is a serious problem. If its temperature is uneven, the heater plate is subjected to a thermal stress greater than in the case where the temperature distribution is uniform, so that it may be broken.

[Problem 2]

In the process of embedding the heater wire in ceramics material powder and sintering it, its surface layers react with carbon in the ceramics material and are carbonized, so that they may possibly suffer grain boundary cracks. If the heater wire is thin, grain boundary cracks 4 inevitably advance to the interior of a heater wire 1 through a reactive layer 3 between the heater wire 1 and ceramics 2, shown in FIG. 7 or 8. The heater wire 1 shown in FIG. 7 is 25 μm thick, while the heater wire 1 shown in FIG. 8 is 50 μm thick. FIGS. 7 and 8 are sectional views based on SEM (scanning electron microscope) photographs.

If the heater wire suffers the aforesaid grain boundary cracks, its electrical resistance is caused to exceed a normal value in the process of sintering the ceramics material powder. If the electrical resistance of the heater wire becomes higher, sufficient current cannot flow, so that the temperature characteristics of the ceramics heater are adversely affected.

[Problem 3]

Since the conventional heater wire is thin and has a small cross section, its load density (Q/S1) is high. Q is the heating value of the heater wire, and S1 is the overall surface area of the wire. If the load density is high, the heater wire may possibly snap during use (or when it is supplied with current). Since the heater wire is thin, moreover, variation of its thickness causes substantial fluctuations of the heating value and exerts a bad influence upon the temperature uniformity. Possibly, furthermore, the heater wire may snap when it is embedded in the ceramics material or sintered unless it is embedded carefully.

BRIEF SUMMARY OF THE INVENTION

Accordingly, the object of the present invention is to provide a ceramics heater that enjoys satisfactory temperature uniformity and a stable heating value.

A ceramics heater according to the invention comprises a heater plate formed of ceramics and a metal foil heater wire formed of a high-melting metal, having a thickness of 100 μm to 175 μm, and embedded in the heater plate. According to the invention, the metal foil heater wire that is longer enough than that of a conventional ceramics heater can be embedded in the heater plate. Thus, the temperature uniformity of the heater plate is improved. According to the invention, grain boundary cracks that may be formed in the surface layers of the heater wire when the ceramics is sintered can be prevented from affecting the entire profile of the heater wire. Accordingly, variation of the heating value that is attributable to cracking of the heater wire can be restrained.

The heater plate is formed of aluminum nitride (AlN), for example. The metal foil heater wire of the invention has a thickness of 100 μm or more. If the heating value is fixed, therefore, the heater wire can be made longer than a conventional metal foil heater wire (50 μm or less in thickness). According to this arrangement, the temperature uniformity of the heater plate of aluminum nitride can be improved, and variation of the heat release value attributable to cracking of the heater wire can be restrained.

The metal foil heater wire is formed flush in zigzags, for example. According to this arrangement, the long metal foil heater wire can be laid out on the same plane in the heater plate, so that the temperature uniformity can be further improved.

Preferably, in order to improve the temperature uniformity of the heater plate additionally, the metal foil heater wire includes an inside portion located near the center of the heater plate and formed in zigzags at first pitches in the circumferential direction of the heater plate and an outside portion located near the outer periphery of the heater plate and formed in zigzags at second pitches in the circumferential direction of the heater plate, the second pitches being shorter than the first pitches. According to this arrangement, the diametrical temperature distribution of the heater plate can be made more uniform.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will now be described with reference to FIGS. 1 to 6.

Figure 1:
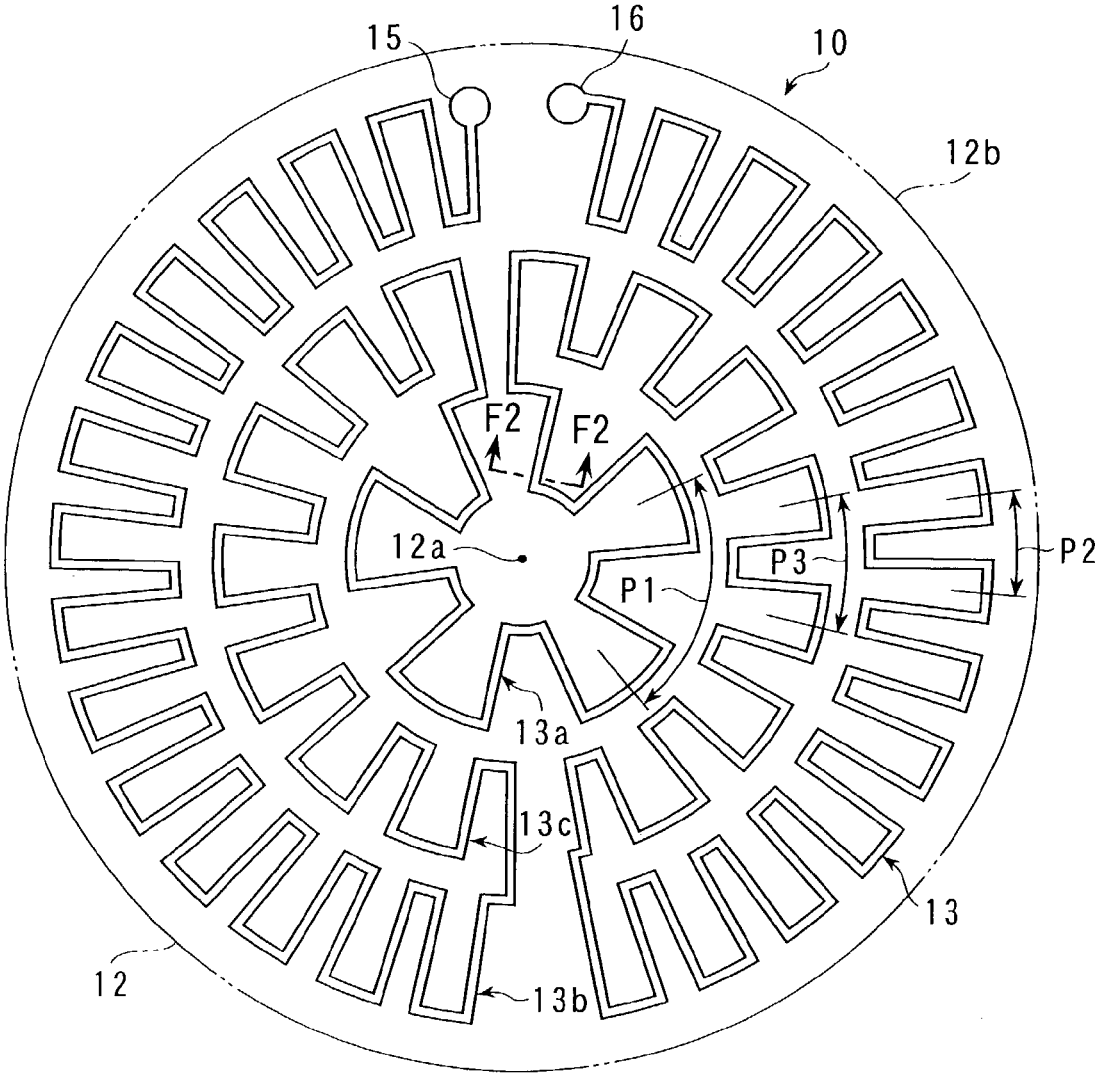
FIG. 1 is a plan view showing a metal foil heater wire of a ceramics heater according to an embodiment of the invention.
Figure 2:
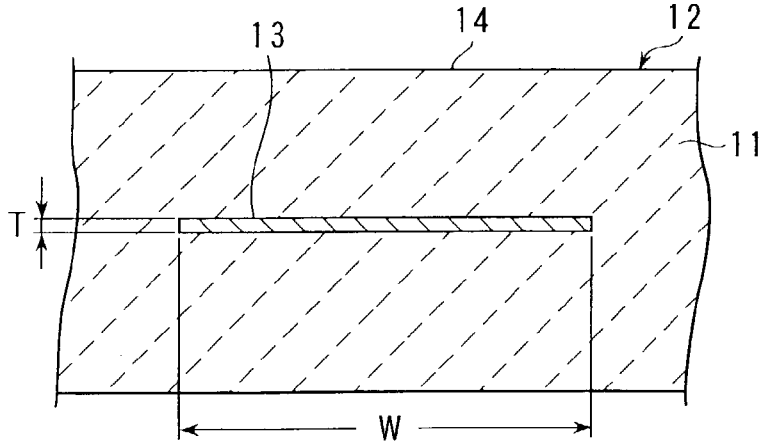
FIG. 2 is a partial sectional view of the ceramics heater taken along line F2-F2 of FIG. 1.

As shown in FIGS. 1 and 2, a ceramics heater 10 comprises a substantially circular heater plate 12, formed of ceramics 11 such as aluminum nitride, and a metal foil heater wire 13 embedded in the plate 12. The heater plate 12 is formed by sintering ceramics material powder into a given shape. In FIG. 1, the heater plate 12 is shown only in outline.

The ceramics heater 10 is used in a semiconductor manufacturing device or a thin-film manufacturing device for glass substrates, for example. The upper surface of the heater plate 12 forms a flat work bearing surface 14 that can support a work such as a semiconductor wafer thereon. The heater plate 12 has a diameter of about 250 mm and a thickness of 15 mm to 30 mm, for example. Since these dimensions are suitably set according to the specifications, such as dimensions, of the work to be heated, however, they are not limited to the above values. Besides aluminum nitride, for example, alumina, magnesia, etc. may be used as the material of the heater plate 12.

As is typically shown in FIG. 2, the metal foil heater wire 13 is embedded in the heater plate 12. The thickness (T) of the wire 13 is adjusted to the range from 100 μm to 175 μm for the following reasons. The wire 13 is formed of a high-melting metal such as molybdenum or tungsten. The heater wire 13 is formed in a zigzag shape on the same plane by etching or some other manufacturing method. The width (W) of the wire 13 is adjusted to, for example, about 2 to 3 mm.

Figure 3:
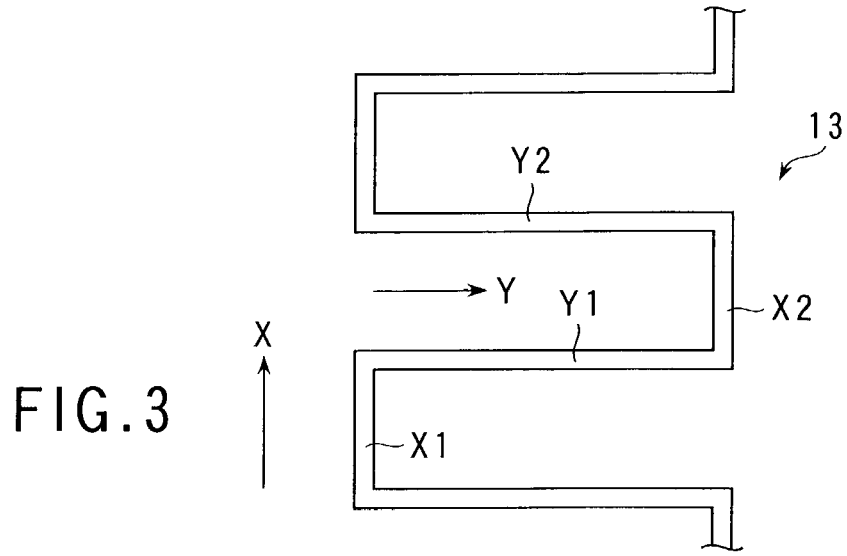
FIG. 3 is a plan view typically showing a part of the heater wire.

The zigzag shape described herein is composed of a series of sets of portions X1, Y1, X2 and Y2, as is typically shown in FIG. 3. The portion X1 extends in a first direction X, and the portion Y1 extends in a second direction Y from an end of the portion X1. The portion X2 extends again in the first direction X from an end of the portion Y1, and the portion Y2 extends in the direction opposite to the second direction Y from an end of the portion X2. The angle formed between the first and second directions X and Y may be any other angle than 90°. The portions X1, Y1, X2 and Y2 may be curved.

The heater wire 13 has an inside portion 13*a* formed near a center 12*a* of the heater plate 12 and an outside portion 13*b* near an outer periphery 12*b* of the plate 12. The inside portion 13*a* is formed in zigzags at first pitches P1 in the circumferential direction of the plate 12. The outside portion 13*b* is formed in zigzags at second pitches P2 in the circumferential direction of the plate 12.

An intermediate portion 13*c* is formed between the inside and outside portions 13*a* and 13*b*. The pitches P3 of the intermediate portion 13*c* are shorter than the pitches P1 of the inside portion 13*a* and longer than the pitches P2 of the outside portion 13*b*. These portions 13*a*, 13*b* and 13*c* are connected electrically in series with one another.

Metallic terminals 15 and 16 are provided individually on the opposite ends of the heater wire 13. The terminals 15 and 16 are fixed to the heater plate 12 by brazing or the like. The heater wire 13 generates heat if voltage is applied to the terminals 15 and 16 to supply current to the wire 13. As the wire 13 generates heat, the heater plate 12 is heated, whereupon the work on the work bearing surface 14 is heated.

That part of the heater plate 12 which is situated nearer to the outer periphery 12*b* of the heater plate 12 radiates heat more easily than that part nearer to the center 12*a* does. In this embodiment, however, the pitches P2 of the outside portion 13*b* are longer than the pitches P1 of the inside portion 13*a*, so that the diametrical temperature distribution of the heater plate 12 can be made more uniform.

The metal foil heater wire 13 has a thickness of 100 μm or more and a cross section several times as large as that of a conventional metal foil heater wire. If the heater wire 13 is 100 μm thick, for example, its length should be quadrupled or made longer in order to enjoy the same electrical resistance of the conventional heater wire having a thickness of 25 μm.

Figure 4:
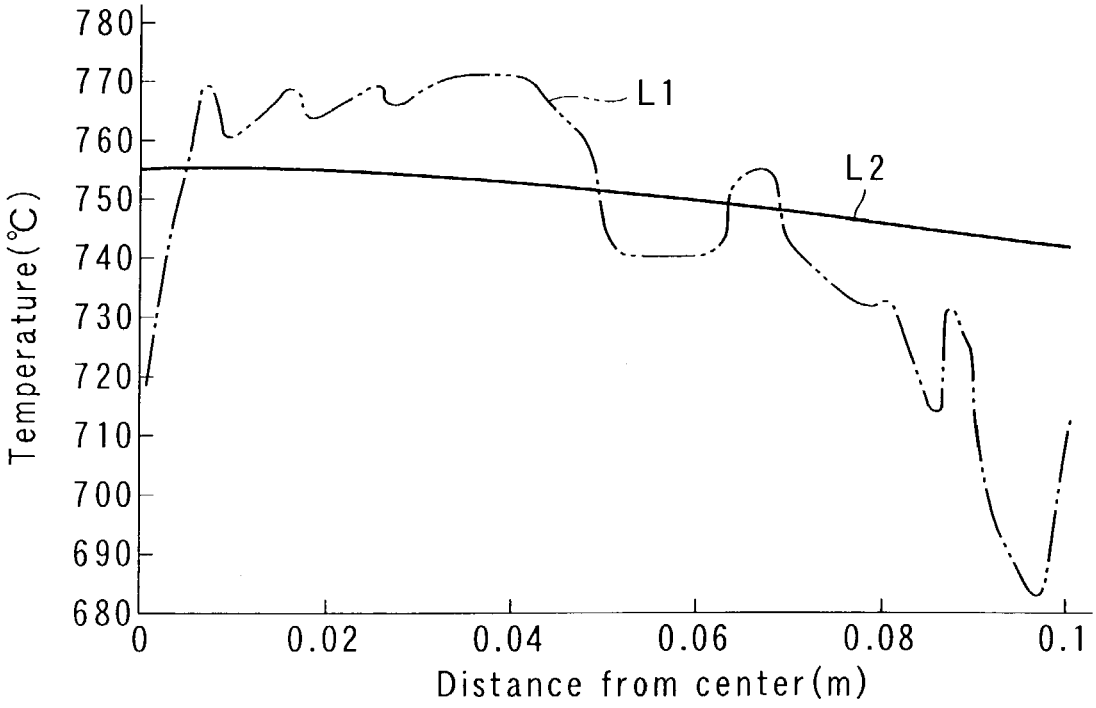
FIG. 4 is a diagram showing the respective diametrical temperature distributions of the ceramics heater shown in FIG. 1 and a conventional ceramics heater.

If the heater wire 13 is lengthened, the aforementioned area ratio (S1/S2) is increased correspondingly, and those regions of the heater plate 12 which are free from the heater wire 13 in the diametrical direction are reduced. In the ceramics heater 10 of this embodiment, the temperature change of the heater plate 12 in the diametrical direction, as indicated by full line L2 in FIG. 4, is smaller than that of a temperature distribution L1 of a ceramics heater that uses the conventional heater wire. Thus, the ceramics heater 10 enjoys excellent temperature uniformity.

In the process of sintering the ceramics 11 that constitute the heater plate 12, the surface layers of the heater wire 13 react with carbon in ceramics material and are carbonized, so that they may possibly suffer grain boundary cracks. In the ceramics heater 10 of this embodiment, however, the heater wire 13 is as thick as 100 μm or more, so that grain boundary cracks can be prevented from advancing to the interior of the heater wire 13.

Figure 5:
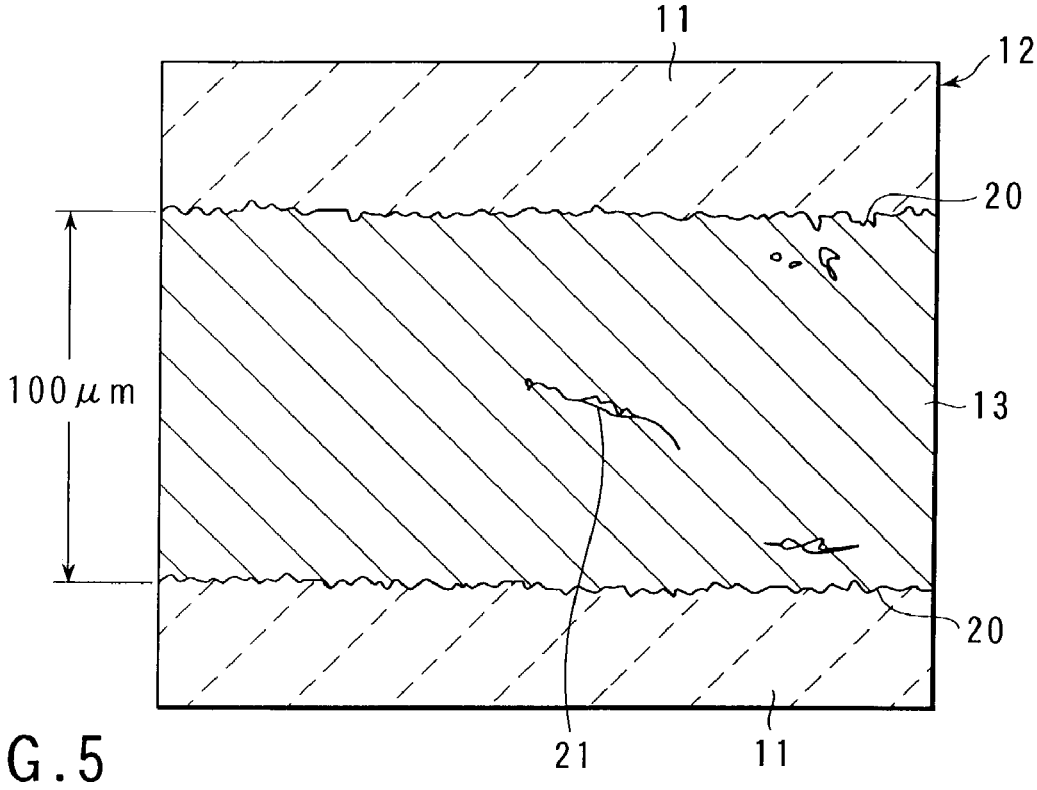
FIG. 5 is an enlarged sectional view showing a part of a ceramics heater using a metal foil heater wire with a thickness of 100 μm.
Figure 6:
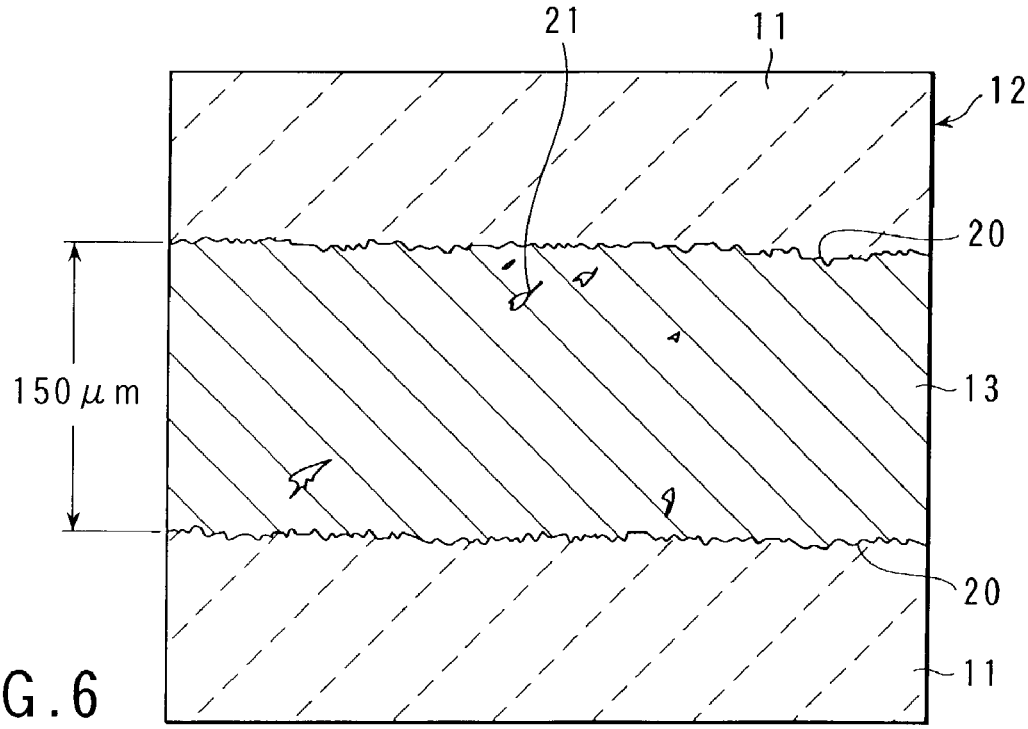
FIG. 6 is an enlarged sectional view showing a part of a ceramics heater using a metal foil heater wire with a thickness of 150 μm.
Figure 7:
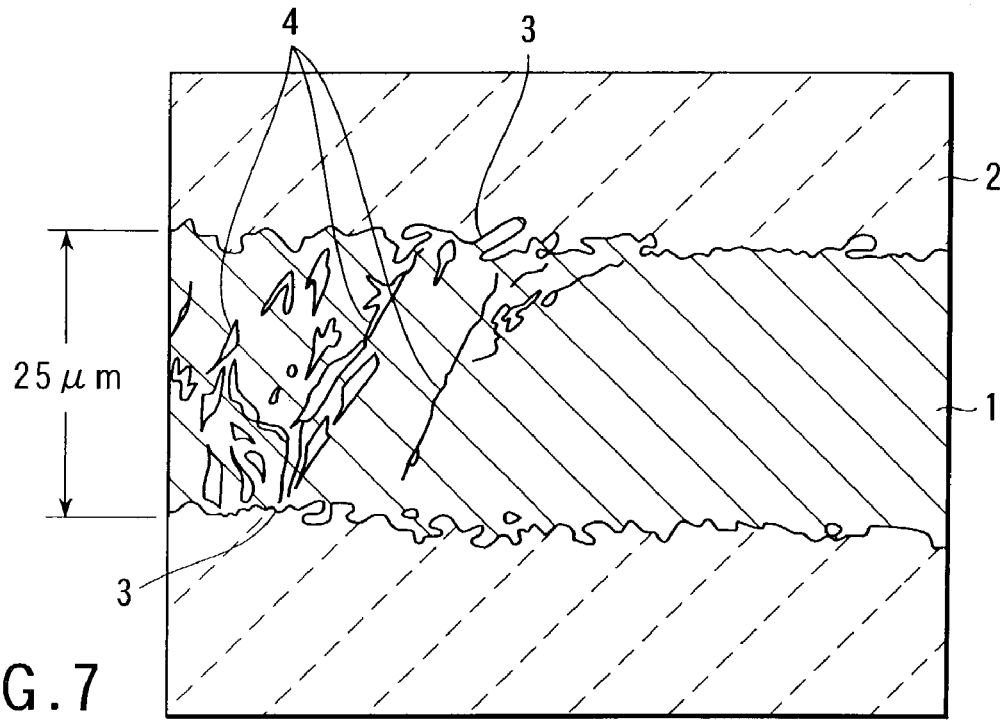
FIG. 7 is an enlarged sectional view showing a part of a conventional ceramics heater using a metal foil heater wire with a thickness of 25 μm.
Figure 8:
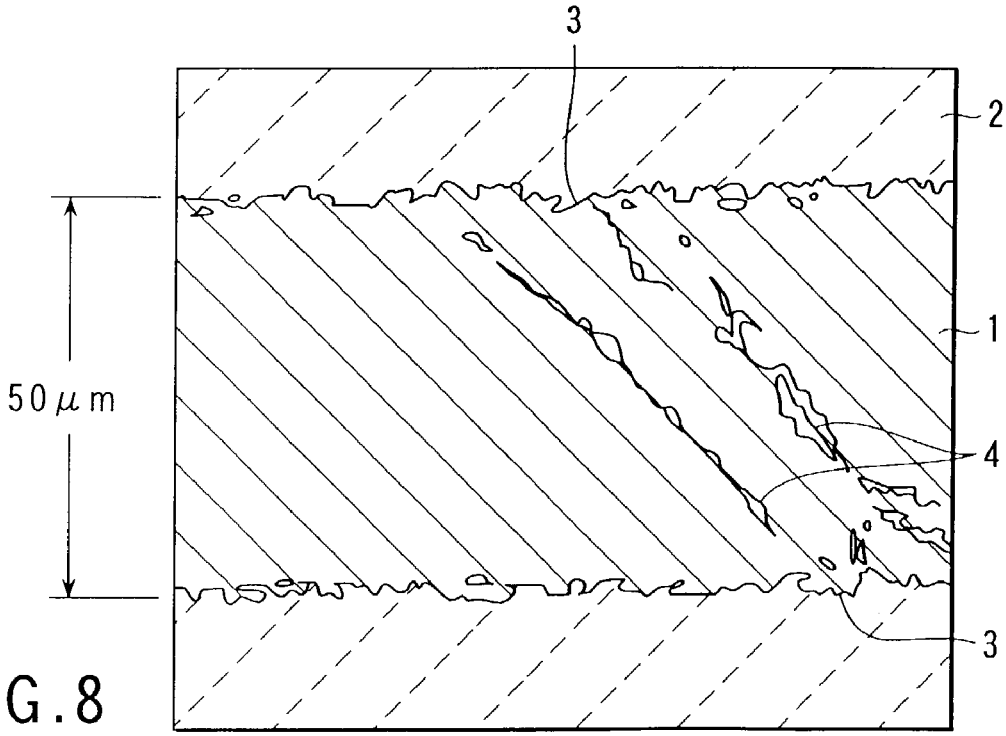
FIG. 8 is an enlarged sectional view showing a part of a conventional ceramics heater using a metal foil heater wire with a thickness of 50 μm.

FIGS. 5 and 6 are sectional views based on SEM (scanning electron microscope) photographs of the ceramics heater 10. The heater wire 13 shown in FIG. 5 is 100 μm thick, while the heater wire 13 shown in FIG. 6 is 150 μm thick. In either of the cases shown in FIGS. 5 and 6, the heater wire 13 and the ceramics 11 are formed of molybdenum and aluminum nitride.

As shown in FIG. 5 or 6, grain boundary cracks formed in surface layers 20 of the heater wire 13 stay in the layers 20. Microcracks 21 in the heater wire 13 have nothing to do with grain boundary cracks, and never exert a bad influence upon the performance of the wire 13.

Since the thickness of the heater wire 13 is adjusted to 100 μm or more in this manner, grain boundary cracks can be prevented from affecting the entire profile of the wire 13. Thus, the electrical resistance of the heater wire 13 can be prevented from exceeding a normal value in the process of sintering the ceramics material powder, so that the temperature characteristics of the ceramics heater 10 are improved.

TABLES 1 and 2 show the results of checkups of the presence of cracks in heater wires and heater plates (ceramics) obtained when the thickness of the heater wires was varied from 25 μm to 200 μm. In TABLES 1 and 2, X indicates the presence of a crack or cracks, while ○ indicates the presence of no crack.

TABLE 1

| | Thickness of heater wire (μm) | | | |
|---|---|---|---|---|
| | 25 | 50 | 100 | 125 |
| Cracking of heater wire by grain boundary cracks | XXX | XX○ | ○○○ | ○○○ |
| Cracking of ceramics | ○○○ | ○○○ | ○○○ | ○○○ |

(n = 3)
○: No crack
X: Cracked

TABLE 2

| | Thickness of heater wire (μm) | | | |
|---|---|---|---|---|
| | 150 | 175 | 200 | 300 |
| Cracking of heater wire by grain boundary cracks | ○○○ | ○○○ | ○○○ | ○○○ |
| Cracking of ceramics | ○○○ | ○○○ | ○○X | XXX |

(n = 3)
○: No crack
X: Cracked

As shown in TABLE 1, some heater wires having a thickness of 25 μm or 50 μm cracked. Heater wires having a thickness of 100 μm or more never cracked. When heater wires with a thickness greater than 200 μm were energized (heated), the ceramics cracked. The ceramics can be supposed to have cracked because the thicker the heater wires, the greater the influence of the difference in thermal expansibility between the heater wires and the ceramics.

In the ceramics heater 10 of the embodiment described above, the heater wire 13 is as thick as 100 μm or more and has a large cross section, so that its load density is lower than that of conventional heater wires. Therefore, the possibility of the heater wire 13 snapping during use is lowered. Since the heater wire 13 is thick, moreover, the heating value of the wire 13 can be prevented from greatly fluctuating owing to the variation in thickness of the wire 13, so that the temperature uniformity can be further improved.

Since the heater wire 13 is thick and highly stiff, furthermore, it can be handled with ease when it is embedded in the ceramics material powder. Therefore, the heater wire 13 can be easily embedded in a predetermined position. Thus, the possibility of the heater wire 13 snapping can be lowered when it is embedded or when the ceramics 11 are sintered.

For these reasons, according to the present invention, the thickness of the metal foil heater wire is restricted to the range from 100 μm to 175 μm.

It is to be understood, in carrying out the invention, that the components of the invention, including the shapes and materials of the heater plate and metal foil heater wire, the pattern of the heater wire, etc., may be suitably changed or modified without departing from the scope or spirit of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A ceramics heater comprising:

a circular heater plate integrally formed of sintered ceramics as one piece having a flat upper surface; and a metal-foil heater wire formed of a high-melting metal, having a thickness of 125 μm to 175 μm, and embedded in the integral circular heater plate parallel to the upper surface so that all surfaces of the metal-foil heater wire contact the sintered ceramics of the circular heater plate, wherein the metal-foil heater wire consists of molybdenum and the sintered ceramics comprise powdered aluminum nitride sintered into a given shape of the integral circular heater plate.

2. A ceramics heater according to claim 1, wherein the metal-foil heater wire is formed flush in zigzags.

3. A ceramics heater according to claim 2, wherein the metal-foil heater wire includes an inside portion located near the center of the integral circular heater plate and formed in zigzags at first pitches in the circumferential direction of the integral circular heater plate and an outside portion located near the outer periphery of the integral circular heater plate and formed in zigzags at second pitches in the circumferential direction of the integral circular heater plate, the second pitches being shorter than the first pitches.

4. A ceramics heater according to claim 1, wherein said surfaces of said metal-foil heater wire react with carbon in said ceramics.

5. A ceramics heater according to claim 1, wherein said foil heater wire has a width of between about 2 to 3 mm.

6. A ceramics heater comprising:

a circular heater plate integrally formed as one piece of sintered ceramics, the heater plate having an upper surface that forms a flat work-bearing surface; and a metal-foil heater wire formed of a high-melting metal, the metal-foil heater wire having a thickness of 125 μm to 175 μm and being embedded in the circular heater plate parallel to the upper surface so that all surfaces of the metal-foil heater wire contact the ceramics, wherein the metal-foil heater wire consists of molybdenum and the sintered ceramics comprise powdered aluminum nitride sintered into a given shape of the circular heater plate.

* * * * *